US008814343B2

(12) United States Patent
Onishi

(10) Patent No.: US 8,814,343 B2
(45) Date of Patent: Aug. 26, 2014

(54) LIQUID EJECTING APPARATUS

(75) Inventor: Hiroyuki Onishi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 286 days.

(21) Appl. No.: 12/881,758

(22) Filed: Sep. 14, 2010

(65) Prior Publication Data

US 2011/0069128 A1 Mar. 24, 2011

(30) Foreign Application Priority Data

Sep. 18, 2009 (JP) ..... 2009-217903

(51) Int. Cl.

| | |
|---|---|
| ***B41J 2/01*** | (2006.01) |
| ***B41J 29/38*** | (2006.01) |
| ***B41J 2/165*** | (2006.01) |
| ***B41J 2/155*** | (2006.01) |
| ***B41J 11/00*** | (2006.01) |

(52) U.S. Cl.

CPC ..... *B41J 11/002* (2013.01)
USPC ..... 347/102; 347/9; 347/23; 347/42

(58) Field of Classification Search

None
See application file for complete search history.

(56) References Cited

U.S. PATENT DOCUMENTS

| | | | | |
|---|---|---|---|---|
| 6,467,898 | B2 * | 10/2002 | Codos et al. | 347/102 |
| 7,510,277 | B2 * | 3/2009 | Konno et al. | 347/102 |
| 7,562,957 | B2 | 7/2009 | Mills et al. | |
| 7,600,867 | B2 | 10/2009 | Mills et al. | |
| 2005/0237352 | A1 * | 10/2005 | Yoneyama | 347/9 |
| 2006/0158481 | A1 * | 7/2006 | Spevak et al. | 347/43 |
| 2006/0221121 | A1 * | 10/2006 | Ide et al. | 347/29 |
| 2008/0238998 | A1 * | 10/2008 | Nakazawa et al. | 347/42 |
| 2009/0167794 | A1 * | 7/2009 | Hosono et al. | 347/6 |

FOREIGN PATENT DOCUMENTS

| | | |
|---|---|---|
| JP | 2000-158793 | 6/2000 |

* cited by examiner

*Primary Examiner* — Alessandro Amari
*Assistant Examiner* — Alexander C Witkowski

(57) ABSTRACT

A liquid ejecting apparatus includes the following elements. A carriage allows a head ejecting liquid which is curable by light irradiation to move in the moving direction intersecting the transporting direction in which a medium is transported. A precuring light source, provided for the carriage, radiates light for precuring to dots formed by applying the liquid ejected from the moving head onto the medium. A full curing light source is provided for the carriage so as to be located downstream of the precuring light source in the transporting direction. The full curing light source radiates light for full curing to the dots which have been irradiated with light for precuring.

16 Claims, 11 Drawing Sheets

FIG. 6A
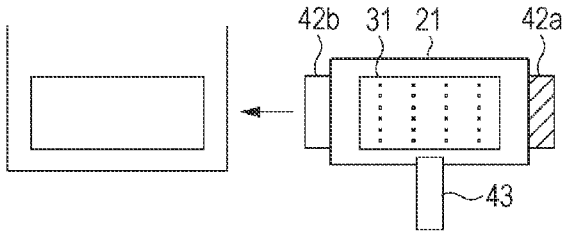
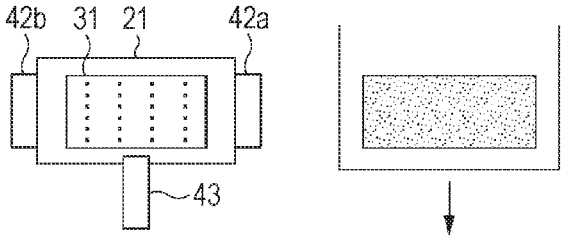
FIG. 6B
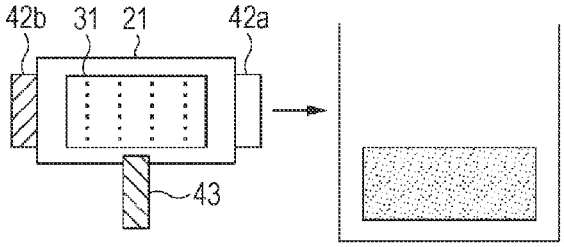
FIG. 6C
FIG. 6D
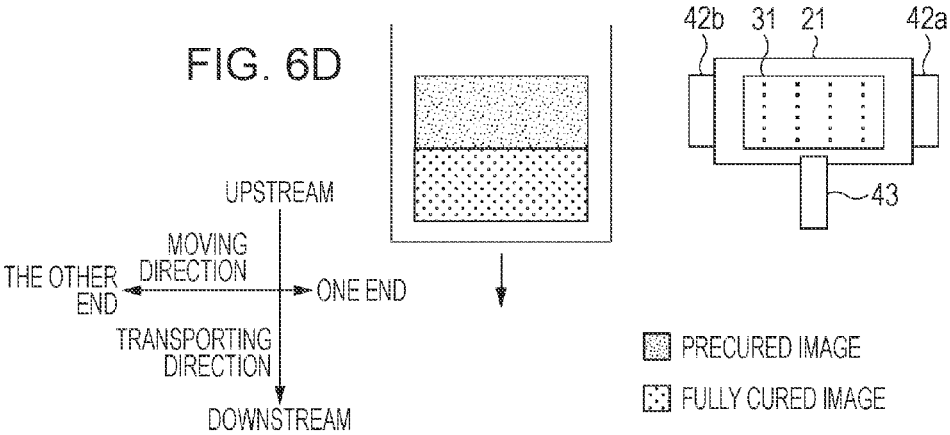

FIG. 7

| IRRADIATION ENERGY ($mJ/cm^2$) | 150 | 180 | 200 | 300 | 400 | 500 | 520 | 550 | |
|---|---|---|---|---|---|---|---|---|---|
| ADHESIVENESS | POOR | POOR | GOOD | GOOD | GOOD | GOOD | GOOD | GOOD | TAPE PEEL TEST |
| ABRASION RESISTANCE | POOR | POOR | GOOD | GOOD | GOOD | GOOD | GOOD | GOOD | GAKUSHIN TYPE ABRASION TEST |
| COLOR STABILITY (NON-YELLOWING) | GOOD | GOOD | GOOD | GOOD | GOOD | GOOD | POOR | POOR | |

FIG. 8

| IRRADIATION ENERGY ($mJ/cm^2$) | 1 | 2 | 3 | 5 | 10 | 15 | 20 | 30 | 31 | 32 | 33 |
|---|---|---|---|---|---|---|---|---|---|---|---|
| BLEED | POOR | POOR | GOOD | GOOD | GOOD | GOOD | GOOD | GOOD | GOOD | GOOD | GOOD |
| UNEVENNESS | POOR | POOR | GOOD | GOOD | GOOD | GOOD | GOOD | GOOD | GOOD | GOOD | GOOD |
| SOLIDITY | GOOD | GOOD | GOOD | GOOD | GOOD | GOOD | GOOD | GOOD | POOR | POOR | POOR |
| GLOSS | EXCELLENT | EXCELLENT | EXCELLENT | EXCELLENT | EXCELLENT | EXCELLENT | GOOD | GOOD | POOR | POOR | POOR |

42b
31
42a
21
43
UPSTREAM
MOVING DIRECTION
THE OTHER END
ONE END
TRANSPORTING DIRECTION
DOWNSTREAM
PRECURED IMAGE
FULLY CURED IMAGE

LIQUID EJECTING APPARATUS

CROSS-REFERENCE TO RELATED APPLICATION

Japanese Patent Application No. 2009-217903 is hereby incorporated by reference in its entirety.

BACKGROUND

1. Field of Invention

The present invention relates to a liquid ejecting apparatus.

2. Description of Related Art

There have been known liquid ejecting apparatuses for printing using liquid (for example, ultraviolet curable (UV) ink) that is curable by irradiation with light (a kind of electromagnetic waves, e.g., ultraviolet rays (UV)). In such a liquid ejecting apparatus, liquid is ejected from nozzles of a head onto a medium and, after that, ink dots (hereinafter, simply referred to as "dots") formed on the medium are irradiated with light. Thus, the dots are cured and are fixed to the medium. Accordingly, good printing can be performed even on a medium that is resistant to absorbing liquid (refer to JP-A-2000-158793, for example).

An apparatus for performing two curing steps has been proposed as one of the above-described type of liquid ejecting apparatuses. For example, just after the formation of dots, the dots are irradiated with light of low irradiation energy, thus preventing ink or dots from bleeding or spreading (precuring). After that, the precured dots are irradiated with light of high irradiation energy, thus fully curing the dots (full curing). In this case, a light source (for full curing) that radiates light for full curing is placed downstream of a head in the transporting direction in which a medium is transported (for example, just before a position where the medium is ejected from the apparatus) so that the length of the light source in the moving direction is longer than a maximum width of the medium subjected to printing.

Disadvantageously, in such a liquid ejecting apparatus, heat generation due to light irradiation for full curing is large.

SUMMARY OF INVENTION

An advantage of some aspects of the invention is to reduce heat generation.

An advantage of some aspects of the invention is to provide a liquid ejecting apparatus including the following elements. A carriage allows a head ejecting liquid which is curable by light irradiation to move in the moving direction intersecting the transporting direction in which a medium is transported. A precuring light source, provided for the carriage, radiates light for precuring to dots formed by applying the liquid ejected from the moving head onto the medium. A full curing light source is provided for the carriage so as to be located downstream of the precuring light source in the transporting direction. The full curing light source radiates light for full curing to the dots which have been irradiated with light for precuring.

Other features of the invention will become more apparent from descriptions of this specification and the accompanying drawings.

BRIEF DESCRIPTION OF THE DRAWINGS

The invention will be described with reference to the accompanying drawings, wherein like numbers reference like elements.

FIGS. 6A to 6D are diagrams explaining states of image formation in a first embodiment.

FIG. 7 is a table illustrating results of evaluation on full curing irradiation conditions.

FIG. 8 is a table illustrating results of evaluation on precuring irradiation conditions.

DESCRIPTION OF THE PREFERRED EMBODIMENTS

At least the following matters will become apparent from descriptions of this specification and the accompanying drawings.

A liquid ejecting apparatus includes the following elements. A carriage allows a head ejecting liquid which is curable by light irradiation to move in the moving direction intersecting the transporting direction in which a medium is transported. A precuring light source, provided for the carriage, radiates light for precuring to dots formed by applying the liquid ejected from the moving head onto the medium. A full curing light source is provided for the carriage so as to be located downstream of the precuring light source in the transporting direction. The full curing light source radiates light for full curing to the dots which have been irradiated with light for precuring.

In this apparatus, since the full curing light source can be made compact, heat generation can be reduced.

In the liquid ejecting apparatus, preferably, the full curing light source is an LED.

In this apparatus, since the full curing light source has small heat generation, it is suitable to be mounted on the carriage.

In the liquid ejecting apparatus, preferably, the full curing light source has a wider wavelength range than that of the precuring light source.

Accordingly, this apparatus can reliably perform full curing.

In the liquid ejecting apparatus, preferably, the precuring light source is provided in each of one end portion and the other end portion of the carriage in the moving direction such that the precuring light sources are arranged on opposite sides of the head on the carriage, and the length in the moving direction of the full curing light source corresponds to the distance between the outer longitudinal edges of the two precuring light sources.

In this apparatus, a loss of power consumption upon movement of the carriage can be reduced.

In the liquid ejecting apparatus, preferably, the energy of light irradiation for full curing by the full curing light source is in the range of 200 to 500 mJ/cm$^2$.

In this apparatus, the quality of an image can be increased.

In the liquid ejecting apparatus, preferably, the energy of light irradiation for precuring by the precuring light source is in the range of 3 to 30 mJ/cm$^2$.

In this apparatus, the quality of an image can be increased.

In the liquid ejecting apparatus, preferably, the degree of cure of the dots irradiated with light for precuring is in the range of 20% to 35%.

In this apparatus, the quality of an image can be increased.

In the following embodiments, an ink jet printer (hereinafter, also referred to as "printer 1") will be described as an example of the liquid ejecting apparatus.

First Embodiment

Structure of Printer

Figure 1:
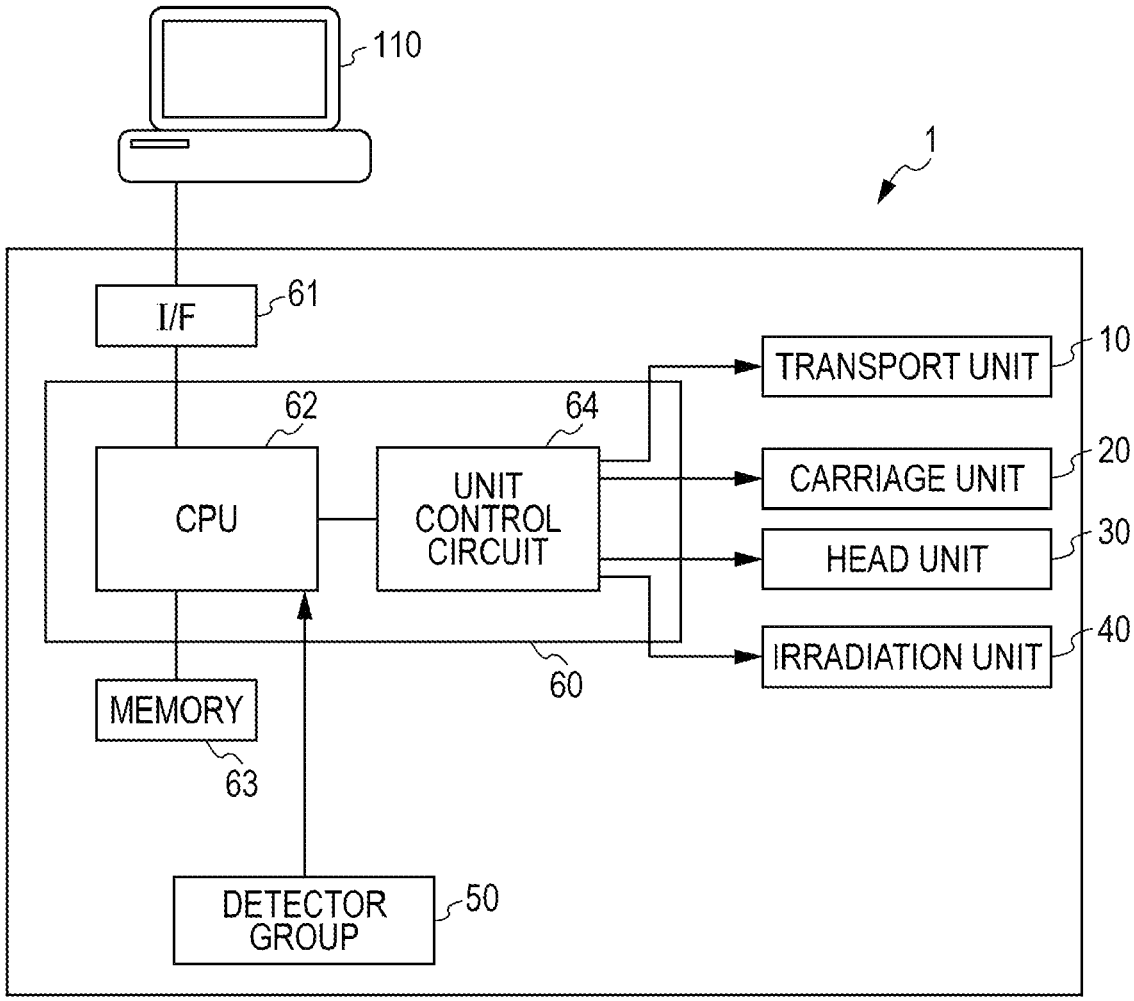
FIG. 1 is a block diagram illustrating the structure of a printer.
Figure 2:
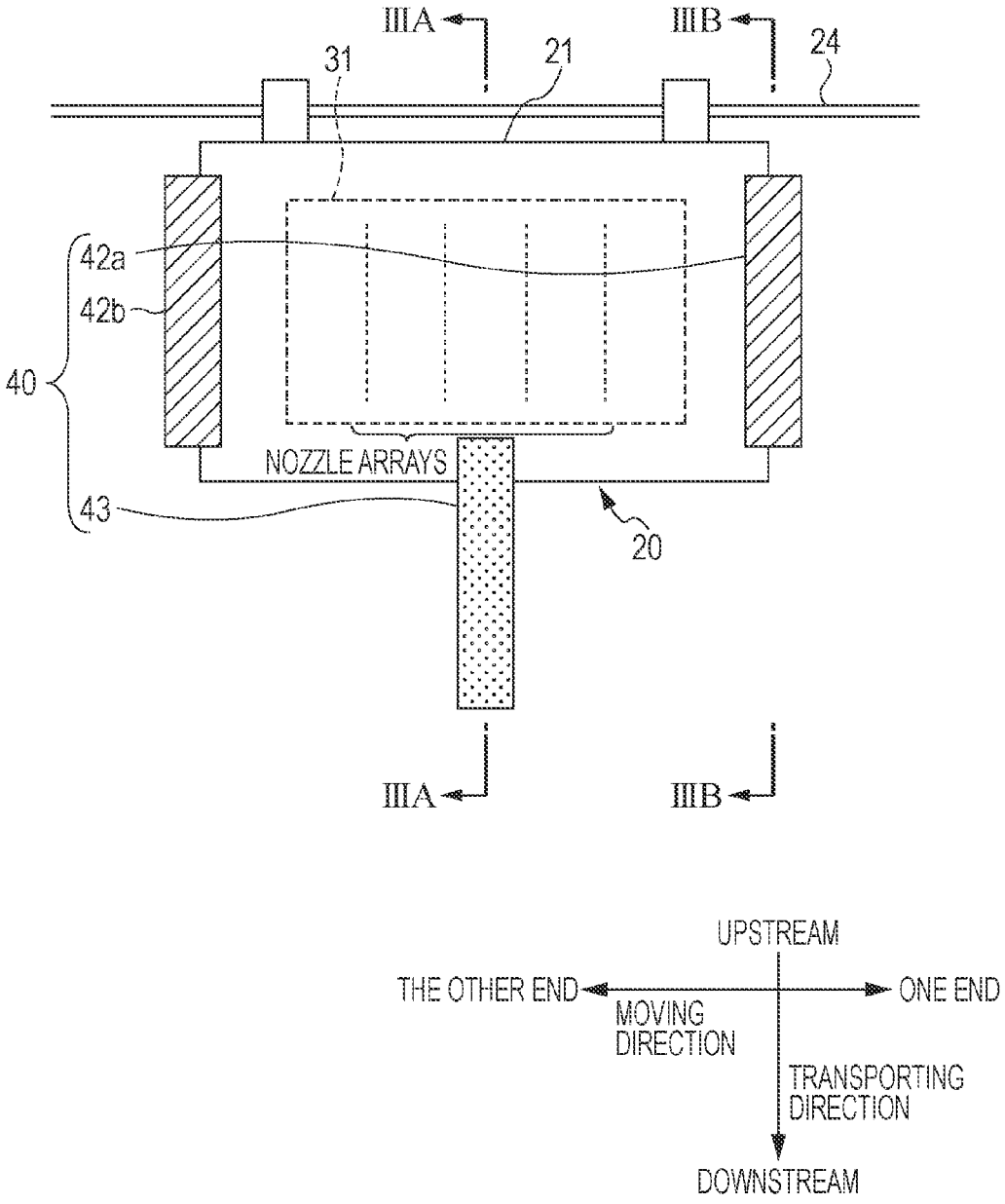
FIG. 2 is a schematic diagram illustrating a head of the printer and its surroundings.
Figure 3A:
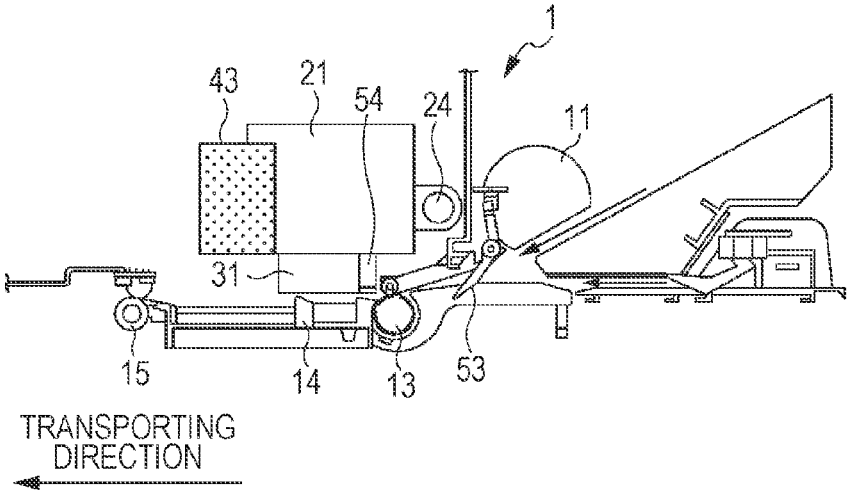
FIGS. 3A and 3B are transverse sectional views of the printer.
Figure 3B:
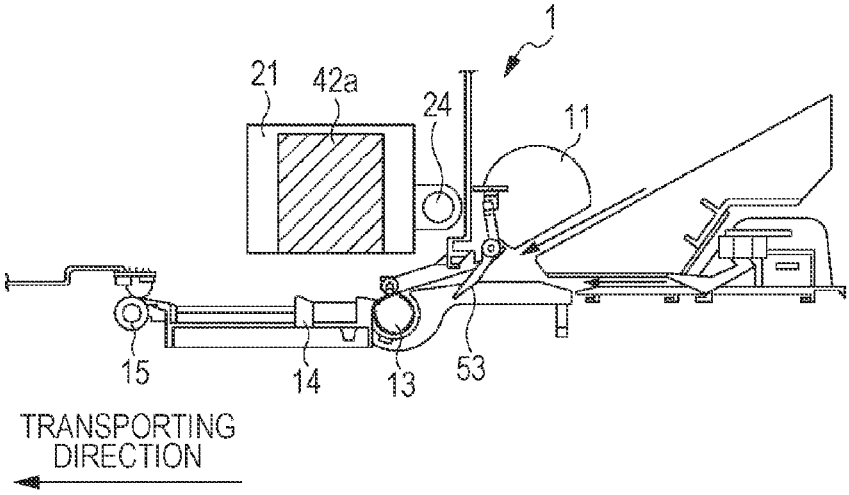

A printer 1 according to a first embodiment will be described below with reference to FIGS. 1, 2, 3A, and 3B. FIG. 1 is a block diagram illustrating the structure of the printer 1. FIG. 2 is a schematic diagram illustrating a head of the printer 1 and its surroundings. FIGS. 3A and 3B are transverse sectional views of the printer 1. FIG. 3A corresponds to the section taken along the line IIIA-IIIA in FIG. 2. FIG. 3B corresponds to the section taken along the line IIIB-IIIB in FIG. 2.

The printer 1 according to this embodiment ejects liquid, for example, ultraviolet curable ink (hereinafter, "UV ink") that is curable by irradiation with ultraviolet rays (UV) onto a medium, such as paper, cloth, or a film sheet to print an image on the medium. When UV-irradiated, the UV ink is cured by photopolymerization. The printer 1 according to this embodiment prints an image using four different color UV inks of cyan (C), magenta (M), yellow (Y), and black (K).

The printer 1 includes a transport unit 10, a carriage unit 20, a head unit 30, an irradiation unit 40, a detector group 50, and a controller 60. When receiving print data from a computer 110 which serves as an external device, the printer 1 allows the controller 60 to control the individual units, i.e., the transport unit 10, the carriage unit 20, the head unit 30, and the irradiation unit 40. The controller 60 controls the units on the basis of the print data received from the computer 110 to print an image on a medium. A state in the printer 1 is monitored by the detector group 50. The detector group 50 outputs data indicating a result of detection to the controller 60. The controller 60 controls the units on the basis of the data indicating the detection result output from the detector group 50.

The transport unit 10 is a mechanism for transporting a medium (e.g., a sheet of paper) in a predetermined direction (hereinafter, referred to as "transporting direction"). The transport unit 10 includes a paper feed roller 11, a transport motor (not illustrated), a transport roller 13, a platen 14, and a paper eject roller 15. The paper feed roller 11 feeds a medium inserted through a paper inlet into the printer. The transport roller 13, driven by the transport motor, transports the medium fed by the paper feed roller 11 to a printing area. The platen 14 supports the medium which is being subjected to printing. The paper eject roller 15 ejects the medium to the outside of the printer and is placed downstream of the printing area in the transporting direction.

The carriage unit 20 allows a head to move (also called "scan") in a predetermined direction (hereinafter, referred to as "moving direction"). The carriage unit 20 includes a carriage 21 and a carriage motor (not illustrated). The carriage 21 detachably holds an ink cartridge storing the UV inks. The carriage 21 reciprocates along a guide shaft 24 while being supported by the guide shaft 24 inserting the transporting direction, which will be described below.

The head unit 30 is a mechanism for ejecting liquid (the UV inks in this embodiment) onto a medium. The head unit 30 includes the head, indicated at 31, including a plurality of nozzles. The head 31 is provided for the carriage 21. Accordingly, as the carriage 21 moves in the moving direction, the head 31 also moves in the moving direction. The head 31 intermittently ejects the UV inks while moving in the moving direction, so that a dot line (raster line) extending in the moving direction is formed on the medium. In the following description, a path for movement from one end to the other end in FIG. 2 will be called "forward movement path" and a path for movement from the other end to the one end will be called "backward movement path". In this embodiment, the UV inks are ejected during movement in both of the forward and backward movement paths. In other words, the printer 1 according to this embodiment performs bidirectional printing.

The structure of the head 31 will be described later.

The irradiation unit 40 radiates UV to the UV inks (dots) applied on a medium. The dots formed on the medium are cured by UV irradiation through the irradiation unit 40. The irradiation unit 40 according to this embodiment includes precuring irradiation sections 42*a* and 42*b* and a full curing irradiation section 43.

The precuring irradiation sections 42*a* and 42*b* are arranged in one end portion and the other end portion of the carriage 21 in the moving direction on opposite sides of the head 31, namely, such that the head 31 is placed between the sections 42*a* and 42*b*. Specifically, the precuring irradiation sections 42*a* and 42*b* are positioned so as to be aligned with the head 31 in the moving direction. The length in the transporting direction of each of the precuring irradiation sections 42*a* and 42*b* is substantially the same as that of each nozzle array of the head 31. The precuring irradiation sections 42*a* and 42*b* move together with the carriage 21 (head 31) and radiate UV to dots formed on a medium. As for a light source for precuring, a light source having a peak wavelength in the range of 365 to 420 nm is preferably used. In this embodiment, the precuring irradiation sections 42*a* and 42*b* each include a single wavelength light emitting diode (LED) having a peak wavelength of approximately 395 nm as a light source for UV irradiation. The LED can easily change irradiation energy by controlling the magnitude of input current.

The full curing irradiation section 43 is placed at the middle of the carriage 21 in the moving direction such that the section 43 is positioned downstream of the precuring irradiation sections 42*a* and 42*b* in the transporting direction. In other words, the full curing irradiation section 43 is provided downstream of the printing area where the inks are applied onto a medium to form dots.

The length in the transporting direction of the full curing irradiation section 43 is substantially the same as that of each nozzle array of the head 31. The full curing irradiation section 43 moves together with the carriage 21 and radiates UV for curing to dots formed on a medium. The full curing irradiation section 43 according to this embodiment includes a plurality of (for example, several tens of) units each including a plurality of LEDs having different wavelengths as light sources for UV irradiation. Thus, the full curing irradiation section 43 has a wider wavelength range than that of the precuring irradiation sections 42*a* and 42*b*. Since the LEDs have smaller heat generation than other light sources, such as a metal halide lamp and a mercury lamp, and also have directivity, the LEDs are suitable to be mounted on the carriage 21.

The details of precuring and full curing will be described later.

The detector group 50 includes, for example, a linear encoder (not illustrated), a rotary encoder (not shown), a paper sensor 53, and an optical sensor 54. The linear encoder detects the position of the carriage 21 in the moving direction. The rotary encoder detects the amount of rotation of the transport roller 13. The paper sensor 53 detects the leading edge of a sheet of paper which is being fed. The optical sensor 54 includes a light emitting portion and a light receiving portion attached to the carriage 21 to detect the presence or absence of a sheet of paper. The optical sensor 54 detects the positions of edges of a sheet of paper while moving together with the carriage 21, thus detecting the width of the sheet. The optical sensor 54 can also detect the leading edge (the edge on the downstream side in the transporting direction or the upper edge) and the trailing edge (the edge on the upstream side in the transporting direction or the lower edge) of the sheet of paper depending on the situation.

The controller 60 is a control unit for controlling the printer 1. The controller 60 includes an interface section 61, a central processing unit (CPU) 62, a memory 63, and a unit control circuit 64. The interface section 61 allows data transmission and reception between the computer 110, serving as the external device, and the printer 1. The CPU 62 is a processor for controlling the entire printer 1. The memory 63 is configured to reserve a storage area for a program for the CPU 62 and a working area. The memory 63 includes storage elements, such as a random access memory (RAM) and an electrically erasable programmable read-only memory (EEPROM). The CPU 62 controls the units through the unit control circuit 64 in accordance with the program stored in the memory 63.

To perform printing, as will be described below, the controller 60 alternately repeats a dot forming operation for allowing the head 31 which is moving in the forward moving direction and the backward moving direction to eject the UV inks and a transporting operation for transporting a sheet of paper in the transporting direction, thus printing an image composed of a plurality of dots onto the sheet. In the following description, the dot forming operation will be called "pass". Accordingly, the nth pass will be called "pass n".

Printing Process

To perform printing based on print data received from the computer 110, the controller 60 allows the units of the printer 1 to perform the following process.

First, the controller 60 rotates the paper feed roller 11 to transport a medium (e.g., a sheet of paper S which will be termed "sheet S" hereinbelow) to be subjected to printing to the transport roller 13. Next, the controller 60 drives the transport motor (not illustrated), thereby rotating the transport roller 13. When the transport roller 13 rotates by a predetermined amount of rotation, the sheet S is transported by a predetermined amount of transportation.

When the sheet S is transported to under the head 31, the controller 60 rotates the carriage motor (not illustrated). The carriage 21 moves in the moving direction in accordance with the rotation of the carriage motor. In addition, as the carriage 21 moves, the head 31, the precuring irradiation sections 42*a* and 42*b*, and the full curing irradiation section 43 on the carriage 21 also move in the moving direction at the same time. The controller 60 allows the head 31 to intermittently eject ink droplets while the head 31 is moving in the moving direction. The ink droplets are applied onto the sheet S, thus forming an array of dots arranged in the moving direction. The controller 60 further allows the precuring irradiation sections 42*a* and 42*b* and the full curing irradiation section 43 to appropriately perform UV irradiation while the head 31 is moving in the moving direction. The details of UV irradiation will be described later.

In addition, the controller 60 drives the transport motor during an interval between the forward and backward movements of the head 31. The transport motor produces a driving force in the rotating direction in accordance with an amount of driving specified by the controller 60. The transport motor rotates the transport roller 13 using this driving force. When the transport roller 13 rotates by the predetermined amount of rotation, the sheet S is transported by the predetermined amount of transportation. In other words, the amount of transportation of the sheet S is determined depending on the amount of rotation of the transport roller 13. As described above, the reciprocation of the head 31 and the transportation of the sheet S are alternately repeated to form dots corresponding to pixels on the sheet S.

The sheet S subjected to printing is ejected by the paper eject roller 15 which rotates synchronously with the transport roller 13. Thus, an image is printed on the sheet S.

Structure of Head

Figure 4:
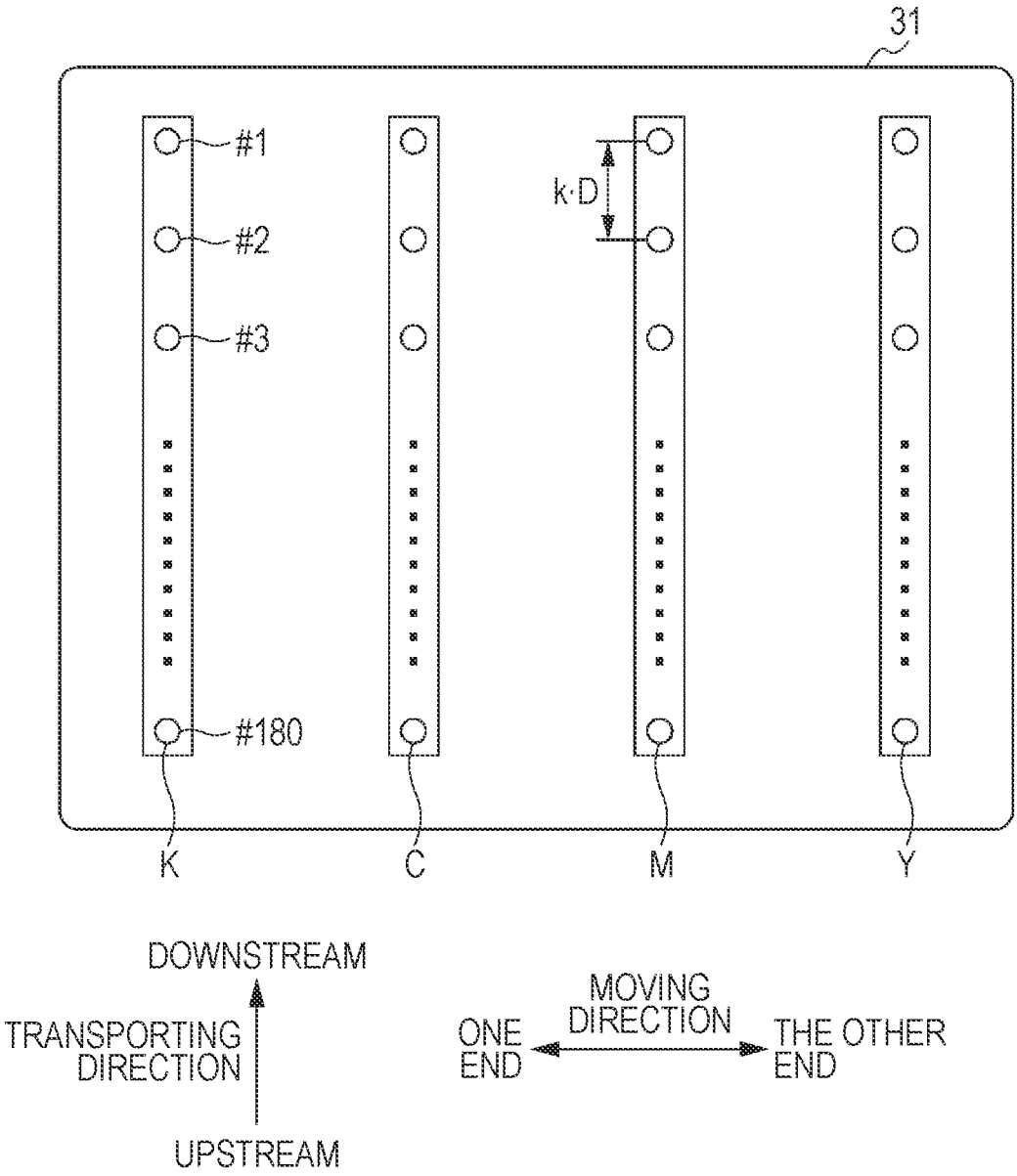
FIG. 4 is a diagram explaining the structure of the head.

FIG. 4 is a diagram explaining an example of the structure of the head 31. Referring to FIG. 4, a black ink nozzle array K, a cyan ink nozzle array C, a magenta ink nozzle array M, and a yellow ink nozzle array Y are arranged on the lower surface of the head 31. Each nozzle array includes a plurality of (in this embodiment, 180) nozzles, serving as ejection ports for ejecting UV ink of the corresponding color.

The nozzles of each nozzle array are aligned at regular intervals (nozzle pitch k·D) in the transporting direction. In this instance, D indicates a minimum dot pitch in the transporting direction (i.e., an interval at the highest resolution of dots formed on a medium) and k is an integer of 1 or greater. For example, assuming that the nozzle pitch is 180 dpi ($1/180$ inch) and the dot pitch in the transporting direction is 720 dpi ($1/720$ inch), k=4.

The nozzles of each nozzle array are numbered in ascending order from the downstream side in the transporting direction. Each nozzle includes a piezo element (not illustrated) that serves as a driving element for allowing the nozzle to eject the UV ink. When the piezo element is driven in accordance with a driving signal, the corresponding nozzle ejects the UV ink in the form of a droplet. The ejected UV ink is applied onto a medium to form a dot.

Precuring and Full Curing

In this embodiment, the UV inks (dots) applied on a medium are irradiated with UV, thus curing the dots. The printer 1 according to this embodiment includes the irradiation unit 40 that includes the precuring irradiation sections 42*a* and 42*b* for UV irradiation for precuring the UV inks and the full curing irradiation section 43 for UV irradiation for full curing so that two curing steps are performed. Precuring is performed in order to prevent bleed of the UV inks applied on a medium and the spread of each dot. Full curing is performed in order to fully cure the UV inks. Therefore, the energy of UV irradiation for full curing is greater than that for precuring.

In this embodiment, the precuring irradiation sections 42*a* and 42*b* and the full curing irradiation section 43 are provided for the carriage 21. Accordingly, as the carriage 21 moves, the head 31, the precuring irradiation sections 42*a* and 42*b*, and the full curing irradiation section 43 move together in the moving direction. While the nozzle arrays of the respective colors of the head 31 are reciprocating in the moving direction, the precuring irradiation sections 42*a* and 42*b* and the full curing irradiation section 43 are reciprocating while being positioned relative to the nozzle arrays of the respective colors.

The precuring irradiation section 42*a* is placed in one end of the carriage 21 in the moving direction such that the section 42*a* is aligned with the head 31 in the moving direction. The precuring irradiation section 42*b* is placed in the other end of the carriage 21 in the moving direction such that the section 42*b* is aligned with the head 31 in the moving direction. When the carriage 21 moves in the moving direction, the precuring irradiation sections 42*a* and 42*b* radiate UV to a medium. Note that the precuring irradiation section located downstream of the head 31 in the moving direction radiates UV. Specifically, the precuring irradiation section 42*a* radiates UV during forward movement and the precuring irradiation section 42*b* radiates UV during backward movement. As described above, precuring is performed in the same pass as that for dot formation during movement of the head 31 in the moving direction.

The full curing irradiation section 43 is placed in the middle of the carriage 21 in the moving direction such that the section 43 is located downstream of the head 31 and the precuring irradiation sections 42*a* and 42*b* in the transporting direction. When the carriage 21 moves, the full curing irradiation section 43 radiates UV to a medium. Since the full curing irradiation section 43 is placed downstream of the head 31 and the precuring irradiation sections 42*a* and 42*b* in the transporting direction, full curing is performed in a pass different from a pass for dot formation or precuring.

As described above, the printer 1 according to this embodiment performs printing by curing the UV inks in two curing steps, i.e., precuring and full curing steps. Precuring is for control of bleed of the UV inks applied on a medium and the spread of each dot. The shape of each dot is substantially determined by precuring.

Figure 5A:
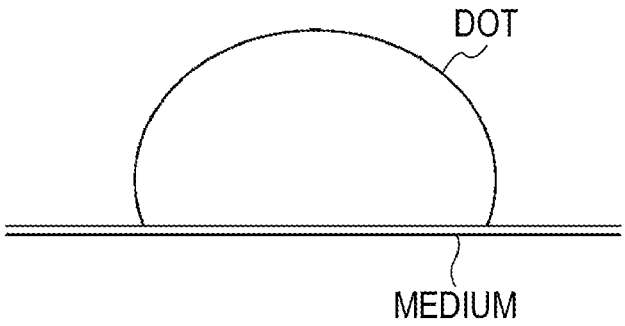
FIGS. 5A to 5C are diagrams explaining the relationship between the shape of a UV ink (dot) applied on a medium and the energy of UV irradiation for precuring.
Figure 5B:
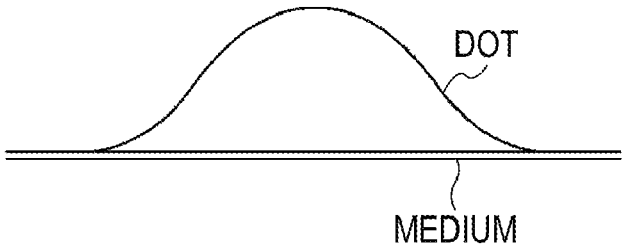
Figure 5C:
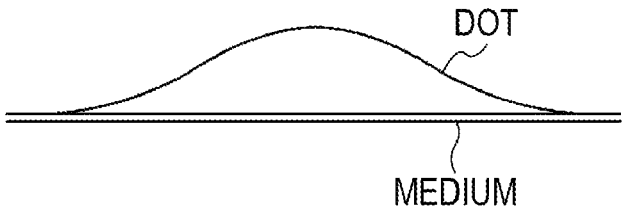

FIGS. 5A to 5C are diagrams explaining the relationship between the shape of a UV ink (dot) applied on a medium and the energy of UV irradiation for precuring. The UV irradiation energy is lower in the order of FIG. 5A, FIG. 5B, and FIG. 5C. Note that the UV irradiation energy ($mJ/cm^2$) is expressed as UV irradiation intensity ($mW/cm^2$)×time (s).

When the UV irradiation energy for precuring is high, the shape is as illustrated in FIG. 5A, for example. In this case, bleed of the inks and the spread of each dot can be prevented. However, asperities, serving as the dots, on the surface of a medium are large. Disadvantageously, the gloss of the surface is degraded.

Whereas, if the UV irradiation energy is low, the shape is as illustrated in FIG. 5C, for example. In this case, the gloss of the medium surface is good. However, bleed of the ink (dot) with another ink tends to easily occur. In addition, the spread of each dot is large.

Printing Operation

A printing operation according to this embodiment will be described below.

FIGS. 6A to 6D are diagrams explaining states of image formation in this embodiment.

FIGS. 6A and 6B illustrate dot formation during forward movement. FIGS. 6C and 6D illustrate dot formation during backward movement. In each of FIGS. 6A to 6D, a used portion (i.e., a UV irradiating portion) of the precuring irradiation sections 42*a* and 42*b* and the full curing irradiation section 43 is indicated by hatching.

Referring to FIG. 6A, the controller 60 allows the nozzles of the head 31 to eject the UV inks while moving the carriage 21 in the moving direction (forward moving direction) in a first pass (pass 1). In addition, after allowing the head 31 to eject the inks, the controller 60 allows the precuring irradiation section (in this case, the precuring irradiation section 42*a* indicated by hatching) to radiate UV. Thus, dots formed on a medium are precured. In this embodiment, since the precuring irradiation sections 42*a* and 42*b* are arranged so as to be aligned with the head 31 on the carriage 21 in the moving direction, the precuring irradiation sections 42*a* and 42*b* can perform UV irradiation for precuring just after the formation of dots. Precuring just after the dot formation can prevent bleed of the inks and can also prevent the spread of each dot.

In this pass 1, an image is printed on the medium, as illustrated in FIG. 6B. This printed image has been subjected to precuring.

After the pass 1, the controller 60 transports the medium by the predetermined amount of transportation (transporting operation). This transporting operation allows the printed image in FIG. 6B to be positioned downstream of the printing area in the transporting direction, as illustrated in FIG. 6C.

After the transporting operation, the controller 60 allows the next pass (pass 2). Referring to FIG. 6C, the controller 60 allows the nozzles of the head 31 to eject the UV inks while moving the carriage 21 in the moving direction (backward moving direction). In addition, after allowing the head 31 to eject the inks, the controller 60 allows the precuring irradiation section (in this case, the precuring irradiation section 42*b* indicated by hatching) located upstream of the head 31 in the moving direction to radiate UV light for precuring, thus performing precuring. In FIG. 6C, since the moving direction is opposite to that in FIG. 6A, the precuring irradiation section on the side opposite from that used in FIG. 6A is used for precuring.

In this pass 2, an image is printed on the medium, as illustrated in FIG. 6D. Just after the formation of dots of the image, the dots are precured by UV irradiation through the precuring irradiation section 42*b*. As described above, precuring is performed just after the dot formation, thus preventing bleed of the inks and the spread of each dot.

Furthermore, in the pass 2, the controller 60 allows the full curing irradiation section 43 which is moving together with the carriage 21 (head 31) in the moving direction to radiate UV for curing to the image printed in the preceding pass (pass 1). Since the full curing irradiation section 43 is placed downstream of the head 31 of the carriage 21 in the transporting direction, the section 43 can irradiate the image (subjected to precuring) formed in the pass 1 with UV for full curing. In this manner, the precured image is fully cured.

Subsequently, the controller 60 similarly alternately repeats the pass and the transporting operation. For example, the transporting operation after the pass 2 allows the precured image in FIG. 6D to be positioned downstream of the printing area in the transporting direction. In a pass 3, the controller 60 allows the head 31 to eject the inks while moving the carriage 21 in the forward moving direction and also allows the precuring irradiation section 42*a* to radiate UV for precuring. In addition, the controller 60 allows the full curing irradiation section 43 to radiate UV for full curing to dots precured in the pass 2 (i.e., the precured image in FIG. 6D). In other words, dots formed on the medium are precured in the same pass as that for formation of the dots and are then cully cured in the next pass.

In this manner, images are printed on the medium.

Irradiation Conditions

As described above, the shape of a dot differs depending on UV irradiation conditions, thus causing variation in image quality. Hence, UV irradiation conditions were evaluated to obtain optimum conditions for the two UV irradiating steps.

Each UV ink is prepared by adding additives, such as a polymerization inhibitor and a surfactant, to a mixture of a photocurable oligomer or monomer, a photoinitiator, and the corresponding pigment. When the ink containing the photoinitiator is irradiated with light, the photoinitiator contained in the ink absorbs light of a specific wavelength range to generate radicals. The radicals attack the monomer molecules, so that polymerization or curing proceeds.

The energy of irradiation for full curing is remarkably larger than (for example, 100 times or more) that for precuring. Therefore, irradiation conditions for full curing were first evaluated.

FIG. 7 illustrates a table showing results of evaluation of irradiation conditions for full curing. In this embodiment, as illustrated in FIG. 7, adhesiveness, abrasion resistance, and color stability (non-yellowing) were evaluated using full curing irradiation energy in the range of 150 to 550 mJ/cm$^2$. The adhesiveness was evaluated by a tape peel test. The abrasion resistance was evaluated using a GAKUSHIN (Japan Society for the Promotion Science: JSPS) type abrasion tester. The color stability was visually evaluated.

Referring to FIG. 7, it is found that the adhesiveness and the abrasion resistance were degraded (became poor) when the energy of UV irradiation for full curing was at or below 180 mJ/cm$^2$. The adhesiveness and the abrasion resistance were good when the full curing UV irradiation energy was at or above 200 mJ/cm$^2$.

On the other hand, when the full curing UV irradiation energy was at or above 520 mJ/cm$^2$, the color stability was degraded (yellowing occurred). When the UV irradiation energy was at or below 500 mJ/cm$^2$, the color stability was good. Yellowing is a phenomenon that the color of ink turns into yellow. Such a phenomenon tends to occur more easily as the UV irradiation energy is higher.

Accordingly, the UV irradiation energy ranging from 200 to 500 mJ/cm$^2$ is suitable for full curing.

Subsequently, UV irradiation conditions for precuring were evaluated. In this embodiment, test patterns were printed while the energy of UV irradiation for precuring was changed within the range (of 200 to 500 mJ/cm$^2$) for the above-described full curing UV irradiation conditions and the image qualities of the patterns were evaluated.

FIG. 8 illustrates a table showing the results of evaluation of precuring UV irradiation conditions. As illustrated in FIG. 8, bleed, unevenness, solidity, and gloss were evaluated using full curing UV irradiation energy ranging from 1 to 33 mJ/cm$^2$. The evaluations in FIG. 8 were visually made.

The bleed occurs in the boundary between different color inks. As described above, when the energy of UV irradiation for precuring is low, the bleed tends to easily occur. The bleed was little (good) when the precuring UV irradiation energy was at or above 3 mJ/cm$^2$.

The unevenness tends to easily occur when the precuring UV irradiation energy is low, as in the case of the bleed. As illustrated in FIG. 8, the unevenness was little (good) when the precuring UV irradiation energy was at or above 3 mJ/cm$^2$.

The solidity is a criterion used to determine whether there is no white linear defect in the scanning direction (in this embodiment, the moving direction) in a printed high density image, or solid image. The solidity is good when the precuring UV irradiation energy is low, contrary to the bleed and the unevenness. The reason is that dots tend to easily spread when the precuring UV irradiation energy is low (refer to FIG. 5C). As illustrated in FIG. 8, the solidity was good when the precuring UV irradiation energy was at or below 30 mJ/cm$^2$.

The gloss is an evaluation on the surface state of a printed image. If the surface is smooth, the gloss is good. If the surface is uneven, the gloss is poor. Therefore, the gloss, like the solidity, is good when the precuring UV irradiation energy is low. As illustrated in FIG. 8, the gloss was good when the precuring UV irradiation energy was at or below 30 mJ/cm$^2$. In particular, when the precuring UV irradiation energy was at or below 15 mJ/cm$^2$, the gloss was excellent.

As described above, UV irradiation energy ranging from 3 to 30 mJ/cm$^2$ is suitable for precuring. In addition, when the precuring UV irradiation energy ranges from 3 to 15 mJ/cm$^2$, the image quality can be further increased. When the irradiation energy was in the range of 3 to 15 mJ/cm$^2$, the degree of cure (also called "degree of polymerization") after precuring was in the range of 20% to 35%. The term "degree of cure" refers to the proportion (percent) of double bonds lost in the monomer in the ink, where the degree of cure indicates 100 percent when the double bonds are completely lost. For example, when the degree of cure is 20%, the percent of double bonds lost in the ink is 20% and that of existing double bonds is 80%. Accordingly, the degree of cure after precuring is set within the range of 20% to 35% and UV irradiation for full curing allows ink dots to be fully cured, so that the image quality can be increased.

Comparative Example

Figure 9:
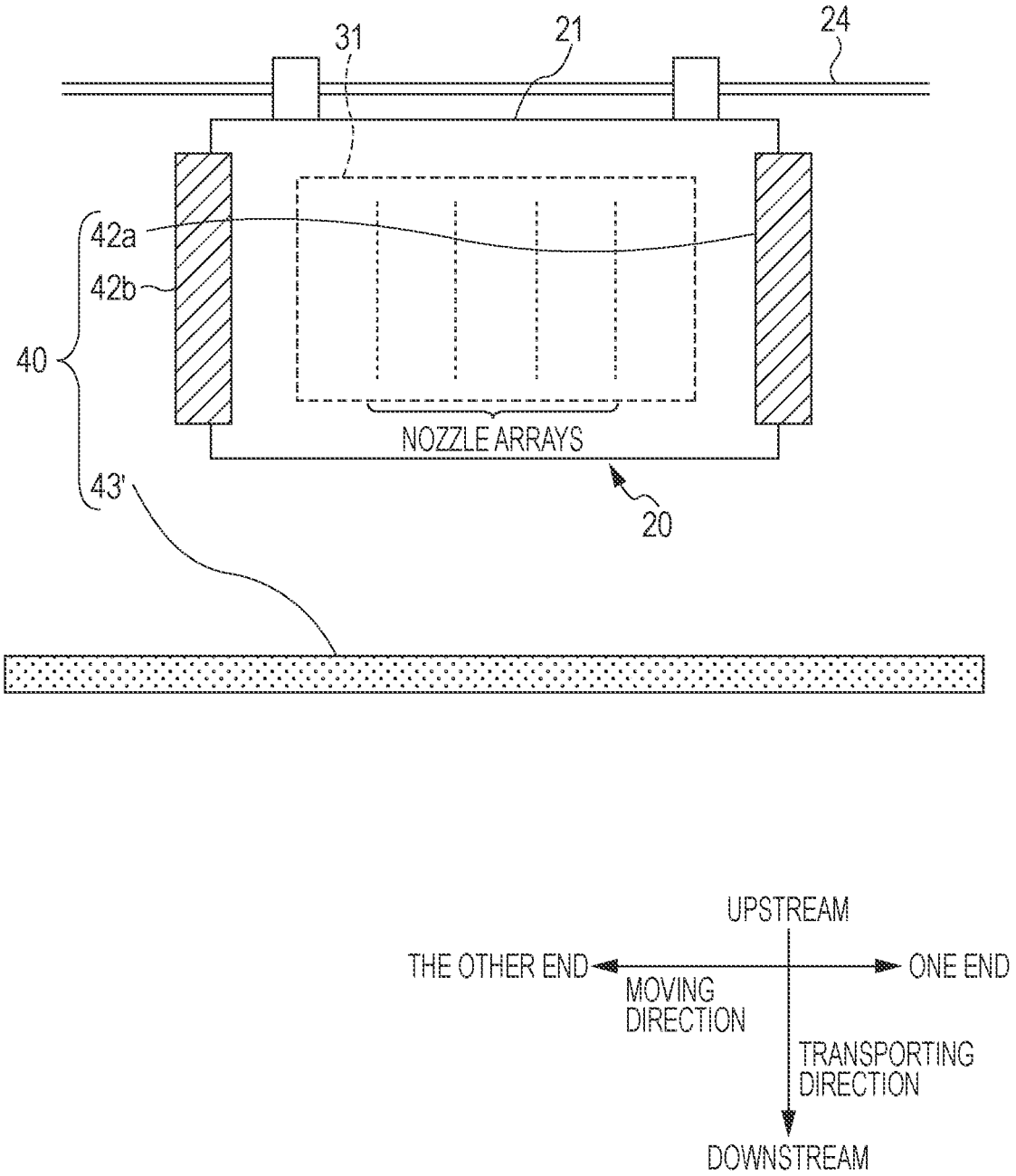
FIG. 9 is a schematic diagram of a head of a printer according to a comparative example and its surroundings.

FIG. 9 is a schematic diagram illustrating a head of a printer according to a comparative example and its surroundings.

In this comparative example, a full curing irradiation section 43' is placed downstream of the carriage 21 in the transporting direction (for example, just before a paper ejection position) so that the length in the moving direction of the section 43' is longer than a maximum width of a medium to be subjected to printing.

In this comparative example, the full curing irradiation section 43' radiates UV for full curing to the medium, which is being transported just before the medium subjected to printing is ejected, without moving. In this manner, dots (subjected to precuring) on the medium are fully cured.

In this comparative example, however, since UV irradiation for full curing is performed in an area having the maximum width of the medium subjected to printing, heat generation is large. In addition, it is difficult to reduce the size of the apparatus (printer) according to the comparative example. Furthermore, it is difficult to perform UV irradiation according to the size of a medium in the comparative example.

On the contrary, according to this embodiment, the full curing irradiation section 43 is provided for the carriage 21. As the carriage 21 moves in the moving direction, the full curing irradiation section 43 also moves in the moving direction and radiates UV for full curing to dots (precured dots) formed in the preceding pass. Thus, according to this embodiment, the full curing irradiation section 43 can be configured smaller than that according to the comparative example, thereby reducing heat generation. In addition, the size of the apparatus can be reduced.

Furthermore, according to this embodiment, a region of UV irradiation for full curing can be changed depending on the size of a medium to be subjected to printing. Advantageously, full curing can be effectively performed.

In this embodiment, the LEDs are included in the light source of the full curing irradiation section 43. Since each LED generates less heat than a lamp and has directivity, the LED is suitable to be mounted on the carriage 21.

Furthermore, in this embodiment, the light source of the full curing irradiation section 43 includes the plurality of units each including a plurality of LEDs having different wavelengths and has a wider wavelength range than those of the precuring irradiation sections 42*a* and 42*b*. Consequently, dots can be fully cured reliably, irrespective of the composition of ink.

Second Embodiment

Structure of Printer

Figure 10:
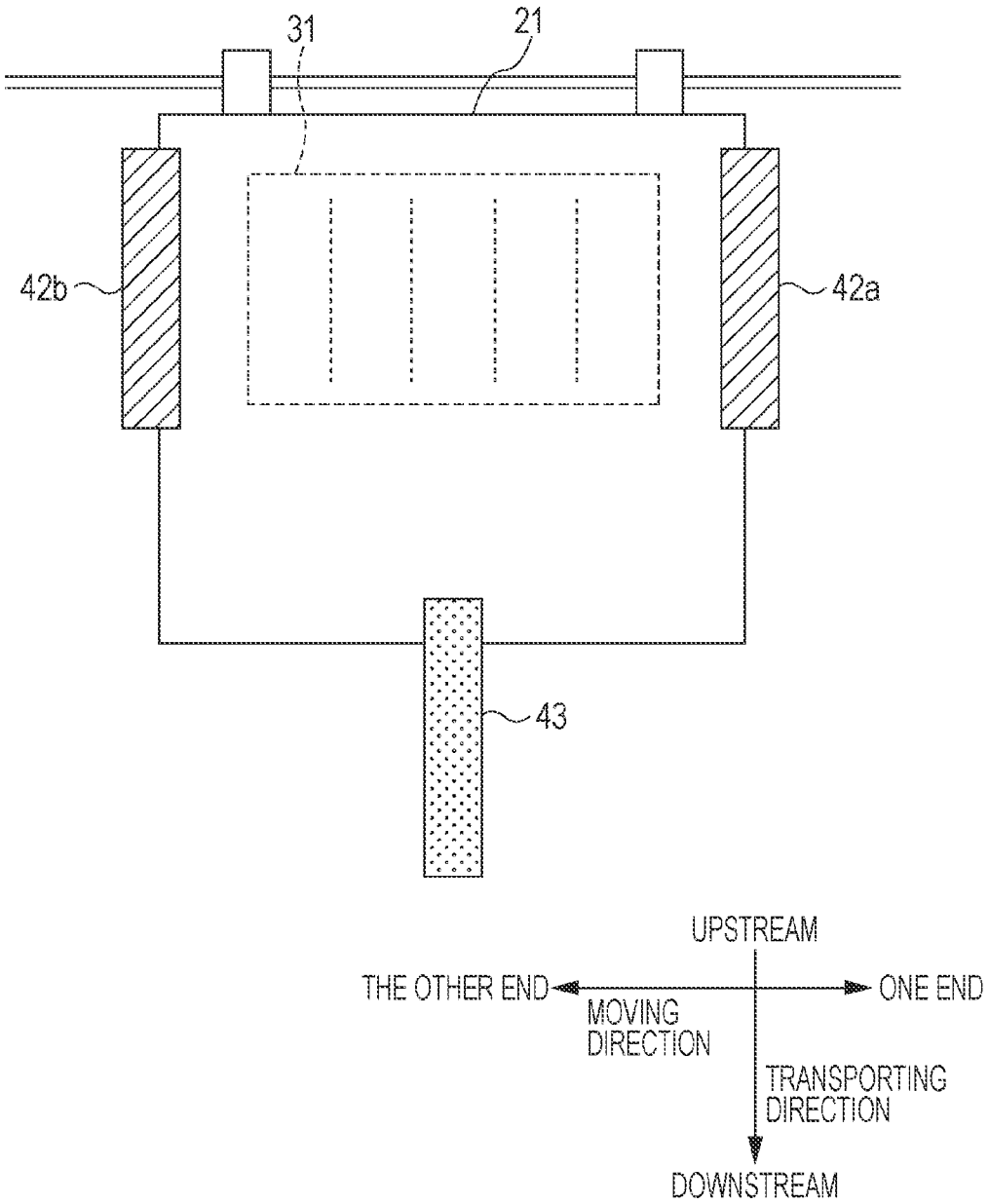
FIG. 10 is a diagram explaining a portion including a head of a printer according to a second embodiment.

FIG. 10 is a diagram explaining a portion including a head of a printer according to a second embodiment. The position of the full curing irradiation section 43 differs from that in the first embodiment.

In the second embodiment, the length in the transporting direction of the carriage 21 is longer than that in the first embodiment (FIG. 2).

Referring to FIG. 10, the full curing irradiation section 43 according to the second embodiment is provided for the carriage 21 such that the section 43 is spaced from the head 31 by a distance corresponding to the length of each nozzle array (hereinafter, referred to as "nozzle array length"). In other words, the full curing irradiation section 43 is similarly spaced from the precuring irradiation sections 42*a* and 42*b* in the transporting direction by the distance corresponding to the nozzle array length.

Printing Operation

A printing operation according to this embodiment will be described below.

FIGS. 11A to 11F are diagrams explaining states of image formation in this embodiment.

Figures 11A, 11B, 11C, 11D, 11E, 11F:
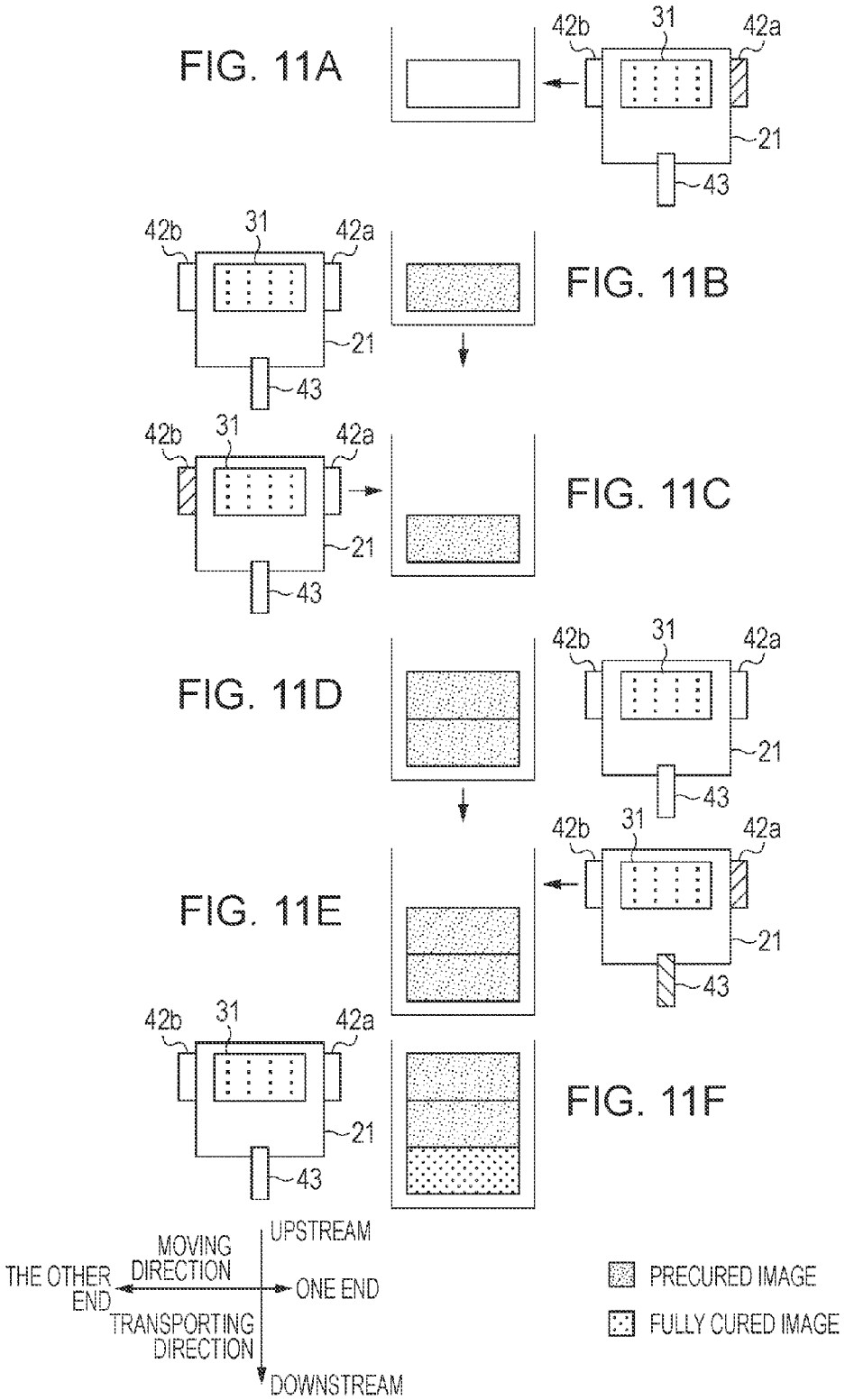
FIGS. 11A to 11F are diagrams explaining states of image formation in the second embodiment.

FIGS. 11A and 11B illustrate dot formation during forward movement (pass 1). FIGS. 11C and 11D illustrate dot formation during backward movement (pass 2). FIGS. 11E and 11F illustrate dot formation during forward movement (pass 3). In FIGS. 11A to 11F, a used portion (i.e., a UV irradiating portion) of the precuring irradiation sections 42*a* and 42*b* and the full curing irradiation section 43 is indicated by hatching.

Since the printing operation in the pass 1 (FIG. 11A) is the same as that in the first embodiment, explanation thereof is omitted. In this pass 1, an image is printed on a medium, as illustrated in FIG. 11B. This printed image has been subjected to precuring.

After the pass 1, the controller 60 transports the medium by a predetermined amount (transporting operation). This transporting operation allows the printed image in FIG. 11B to be located downstream of the printing area in the transporting direction, as illustrated in FIG. 11C.

After the transporting operation, the controller 60 allows the next pass (pass 2). In the pass 2, the controller 60 allows the nozzles of the head 31 to eject the UV inks while moving the carriage 21 in the moving direction (backward moving direction) and also allows the precuring irradiation section 42*b* to radiate UV for precuring in the same way as the first embodiment, thus performing precuring. In FIG. 11C, the moving direction is opposite to that in FIG. 11A. Accordingly, the precuring irradiation section on the side opposite from that used in FIG. 11A is used for precuring.

According to this embodiment, the image (subjected to precuring) printed in the pass 1 is located between the head 31 and the full curing irradiation section 43 in the transporting direction in the pass 2. In other words, the full curing irradiation section 43 is positioned downstream of the image printed in the pass 1 in the transporting direction. Accordingly, UV irradiation for full curing by the full curing irradiation section 43 is not performed in the pass 2 in this embodiment.

In this pass 2, as illustrated in FIG. 11D, an image is printed in a position upstream of the image printed in the pass 1 in the transporting direction. This printed image has also been precured.

After the pass 2, the controller 60 transports the medium by the predetermined amount (transporting operation). This transporting operation allows the image printed in the pass 2 (i.e., the upper image in FIG. 11D) to be located downstream of the printing area in the transporting direction, as illustrated in FIG. 11E. The position of the image printed in the pass 1 (i.e., the lower image in FIG. 11D) in the transporting direction is substantially the same as that of the full curing irradiation section 43.

After the transporting operation, the controller 60 allows the next pass (pass 3). In the pass 3, as illustrated in FIG. 11E, the controller 60 allows the nozzles of the head 31 to eject the UV inks while moving the carriage 21 in the moving direction (forward moving direction). After allowing the head 31 to eject the UV inks, the controller 60 allows the precuring irradiation section (in this case, the precuring irradiation section 42*a* indicated by hatching) located upstream of the head 31 in the moving direction to radiate UV for precuring. Thus, dots formed on the medium are precured.

In this pass 3, as illustrated in FIG. 11F, an image is printed on the medium. Just after the formation of dots of the image, the dots are precured by UV irradiation through the precuring irradiation section 42*a*. The above-described precuring just after the dot formation can prevent bleed of the inks and the spread of each dot.

In the pass 3, the controller 60 allows the full curing irradiation section 43, which moves together with the carriage 21 (head 31) in the moving direction, to irradiate the image printed in the second previous pass (pass 1) with UV for full curing. Since the full curing irradiation section 43 is placed downstream of the head 31 on the carriage 21 in the transporting direction by the distance corresponding to the nozzle array length, the section can irradiate the image (subjected to precuring) formed in the second previous pass (pass 1) with UV for full curing. The precured image is fully cured in this manner.

After that, the controller 60 similarly alternately repeats the pass and the transporting operation. In this embodiment, dots formed on a medium are precured in the same pass as that for formation of the dots and are then fully cured in the second pass after the dot formation pass.

According to this embodiment, the full curing irradiation section 43 is spaced apart from the head 31. This arrangement can prevent nozzle clogging caused when UV light radiated from the full curing irradiation section 43 is reflected by a medium and then reaches the nozzles of the head 31.

Furthermore, the time interval between precuring and full curing in this embodiment can be set longer than that in the first embodiment by an amount corresponding to (one pass+ one transporting operation).

In this embodiment, the distance between the head 31 and the full curing irradiation section 43 is set to the nozzle array length. The distance is not limited to this length. For example, the distance may be half the nozzle array length or an integer multiple of the nozzle array length.

Third Embodiment

Structure of Printer

Figure 12:
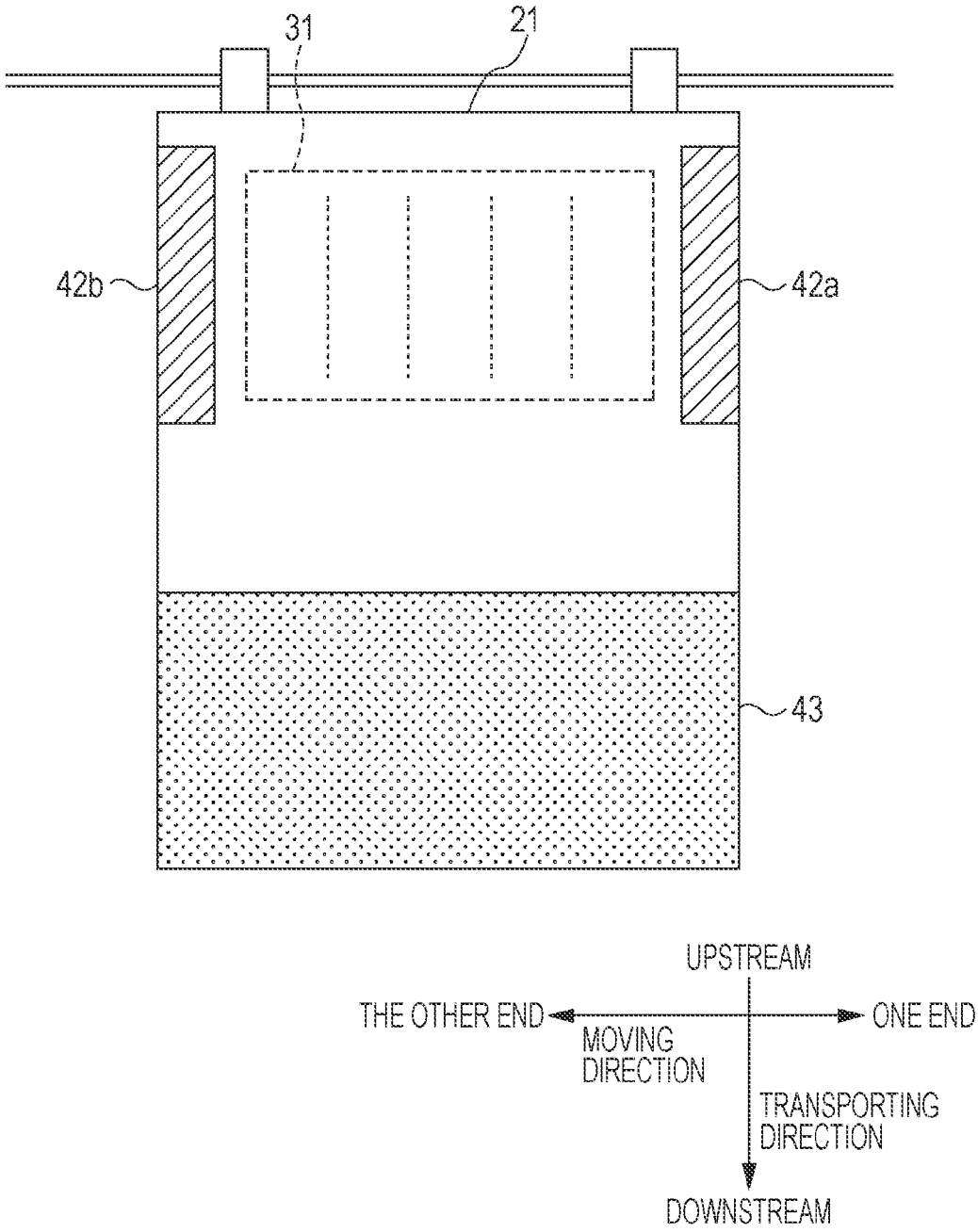
FIG. 12 is a diagram explaining a portion including a head of a printer according to a third embodiment.

FIG. 12 is a diagram explaining a portion including a head of a printer according to a third embodiment. The third embodiment differs from the second embodiment in the length of the full curing irradiation section 43 in the moving direction.

Referring to FIG. 12, the length in the moving direction of the full curing irradiation section 43 according to this embodiment corresponds to the distance between the outer longitudinal ends of two precuring irradiation sections (the precuring irradiation sections 42*a* and 42*b*).

A printing operation in this embodiment is the same as that in the second embodiment. Accordingly, explanation thereof is omitted.

Since the length in the moving direction of the full curing irradiation section 43 is the same as the distance between the outer longitudinal ends of the two precuring irradiation sections (the precuring irradiation sections 42*a* and 42*b*), the time during which a medium is irradiated with UV for full curing in a pass is longer than those in the foregoing embodiments. Consequently, the medium can be irradiated with more UV rays for full curing.

If the length in the moving direction of the full curing irradiation section 43 is longer than the distance between the outer longitudinal ends of the two precuring irradiation sections (the precuring irradiation sections 42*a* and 42*b*), the carriage 21 has to be moved longer in a pass. Thus, the moving distance increases. Disadvantageously, this causes a loss of power consumption.

According to this embodiment, since the length in the moving direction of the full curing irradiation section 43 corresponds to the distance between the outer longitudinal ends of the two precuring irradiation sections (the precuring irradiation sections 42*a* and 42*b*), the moving range in the moving direction of the carriage 21 can be minimized, thus reducing a loss of power consumption.

Other Embodiments

The printer has been described as an embodiment. The foregoing embodiments are intended for easy understanding of the invention and are not intended for limited interpretation of the invention. It should be understood that many modifications and variations of the invention are possible without departing from the spirit and scope of the invention and the invention also includes equivalents thereof. In particular, the invention includes the following embodiments.

Printer

Although the printer has been described as an example of a liquid ejecting apparatus in the foregoing embodiments, the liquid ejecting apparatus is not limited to the printer. The same technique as that described in the embodiments may be applied to various apparatuses using an ink jet technique, for example, a color filter manufacturing apparatus, a dyeing apparatus, a micromachining apparatus, a semiconductor manufacturing apparatus, a surface treatment apparatus, a three-dimensional molding apparatus, a liquid vaporizing apparatus, an organic EL manufacturing apparatus (particularly, a polymer EL manufacturing apparatus), a display manufacturing apparatus, a film deposition apparatus, and a DNA chip manufacturing apparatus.

Nozzles

In the foregoing embodiments, the inks have been ejected using the piezoelectric or piezo elements. A method of ejecting liquid is not limited to this method. Another method, for example, a method of generating bubbles in the nozzles by heat may be used.

Ink

In the foregoing embodiments, the ink (UV ink) which is curable by irradiation with UV has been ejected from each nozzle. Liquid ejected from the nozzle is not limited to this ink. Liquid that is curable by irradiation with light (e.g., visible light rays) other than UV rays may be ejected from the nozzle. In this case, the precuring irradiation sections 42*a* and 42*b* and the full curing irradiation section 43 may radiate light (e.g., visible light rays) for curing the liquid.

In the foregoing embodiments, the four color inks of CMYK have been used. Another color UV ink may be used. For example, white ink for background or clear ink that is transparent and colorless may be used.

Dot Formation

In the foregoing embodiments, bidirectional printing has been performed. Printing is not limited to this type. In other words, unidirectional printing may be performed. In this case, one precuring irradiation section may be located downstream of the head 31 in the moving direction during, at least, dot formation.

In the foregoing embodiments, the case where a raster line corresponding to the nozzle array length is formed in one pass (band printing) has been described. A raster line corresponding to the nozzle array length may be formed in a plurality of passes. For example, interlace printing may be performed. In this case, printing may be performed on the same conditions of UV irradiation energy for dots as those in the foregoing embodiments.

What is claimed is:

1. A liquid ejecting apparatus comprising:

a carriage that allows a head ejecting liquid which is curable by light irradiation to move along a guide shaft intersecting a transporting direction in which a medium is transported, the head having at least one nozzle array extending in the transporting direction;

a precuring light source that is provided for the carriage and radiates light for precuring dots formed by applying the liquid ejected from the head onto the medium, an end of the precuring light source in the transporting direction extending further downstream in the transporting direction than a downstream end of the at least one nozzle array in the transporting direction; and a full curing light source that is provided for the carriage so as to be located downstream of the precuring light source in the transporting direction and radiates light for full curing the dots which have been irradiated with light for procuring;

wherein a length in the transporting direction of the full curing light source is the same as a length of the at least one nozzle array.

2. The apparatus according to claim 1, wherein the precuring light source comprises two precuring light source elements, one being provided in one end portion of the carriage and the other being provided in the other end portion of the carriage such that the precuring light source elements are arranged on opposite sides of the head on the carriage, and a length in the moving direction of the full curing light source is shorter than or equal to a distance between the outer longitudinal edges of the two precuring light source elements.

3. The apparatus according to claim 2, wherein the length in the moving direction of the full curing light source is shorter than or equal to a distance between inner longitudinal edges of the two precuring light source elements.

4. The apparatus according to claim 3, wherein the head has two or more nozzle arrays, each extending in the transporting direction, and the length in the moving direction of the full curing light source is shorter than a distance between two adjacent nozzle arrays in the moving direction.

5. The apparatus according to claim 1, wherein the energy of light irradiation for precuring by the precuring light source is in the range of 3 to 30 mJ/cm$^2$.

6. The apparatus according to claim 1, wherein the degree of cure of the dots irradiated with light for precuring is in the range of 20% to 35%.

7. The apparatus according to claim 1, wherein the full curing light source is an LED;

wherein the full curing light source has a wider wavelength range than that of the precuring light source;

wherein the precuring light source comprises two precuring light source elements, one being provided in one end portion of the carriage and the other being provided in the other end portion of the carriage such that the precuring light source elements are arranged on opposite sides of the head on the carriage;

wherein the length in the moving direction of the full curing light source corresponds to the distance between the outer longitudinal edges of the two precuring light source elements;

wherein the energy of light irradiation for full curing by the full curing light source is in the range of 200 to 500 $mJ/cm^2$;

wherein the energy of light irradiation for precuring by the precuring light source is in the range of 3 to 30 $mJ/cm^2$; and wherein the degree of cure of the dots irradiated with light for precuring is in the range of 20% to 35%.

8. The apparatus according to claim 1, wherein a distance between the head and the full curing light source in the transporting direction is equal to a length of the at least one nozzle array in the transporting direction.

9. A liquid ejecting apparatus comprising:

a carriage that allows a head ejecting liquid which is curable by light irradiation to move along a guide shaft intersecting a transporting direction in which a medium is transported, the head having at least one nozzle array extending in the transporting direction;

a first light source that is provided for the carriage and radiates light for curing dots formed by applying the liquid ejected from the head onto the medium, a length of the first light source in the transporting direction is longer than a length of the at least one nozzle array in the transporting direction; and a second light source that is provided for the carriage so as to be located downstream of the first light source in the transporting direction and radiates light for curing the dots which have been irradiated by the first light source;

wherein energy of light irradiation by the second light source is larger than energy of light irradiation by the first light source; and wherein a length in the transporting direction of the second light source is the same as a length of the at least one nozzle array.

10. The apparatus according to claim 9, wherein the first light source comprises two first light source elements, one being provided in one end portion of the carriage and the other being provided in the other end portion of the carriage such that the first light source elements are arranged on opposite sides of the head on the carriage, and a length in the moving direction of the second light source is shorter than or equal to a distance between the outer longitudinal edges of the two first light source elements.

11. The apparatus according to claim 10, wherein the length in the moving direction of the second light source is shorter than or equal to a distance between inner longitudinal edges of the two first light source elements.

12. The apparatus according to claim 11, wherein the head has two or more nozzle arrays, each extending in the transporting direction, and the length in the moving direction of the second light source is shorter than a distance between two adjacent nozzle arrays in the moving direction.

13. The apparatus according to claim 9, wherein the energy of light irradiation for precuring by the first light source is in the range of 3 to 30 $mJ/cm^2$.

14. The apparatus according to claim 9, wherein the degree of cure of the dots irradiated by the first light source is in the range of 20% to 35%.

15. The apparatus according to claim 9, wherein the second light source is an LED;

wherein the second light source has a wider wavelength range than that of the first light source;

wherein the first light source comprises two first light source elements, one being provided in one end portion of the carriage and the other being provided in the other end portion of the carriage such that the first light source elements are arranged on opposite sides of the head on the carriage;

wherein the length in the moving direction of the second light source corresponds to the distance between the outer longitudinal edges of the two first light source elements;

wherein the energy of light irradiation for full curing by the second light source is in the range of 200 to 500 $mJ/cm^2$;

wherein the energy of light irradiation for precuring by the first light source is in the range of 3 to 30 $mJ/cm^2$; and wherein the degree of cure of the dots irradiated by the first light source is in the range of 20% to 35%.

16. The apparatus according to claim 9, wherein a distance between the head and the second light source in the transporting direction is equal to a length of the at least one nozzle array in the transporting direction.

* * * * *